United States Patent [19]

Taguezout et al.

[11] Patent Number: 4,901,295

[45] Date of Patent: Feb. 13, 1990

[54] DEVICE COMPRISING A SOLAR CELL FOR WINDING A BARREL SPRING

[75] Inventors: Daho Taguezout, Lausanne; Mai T. Xuan, Chavannes, both of Switzerland

[73] Assignee: Asulab S.A., Bienne, Switzerland

[21] Appl. No.: 281,613

[22] Filed: Dec. 9, 1988

[30] Foreign Application Priority Data

Dec. 11, 1987 [CH] Switzerland ..... 4856/87

[51] Int. Cl.[4] ..... G04C 1/00

[52] U.S. Cl. ..... 368/149; 368/205

[58] Field of Search ..... 368/149, 205, 151, 160

[56] References Cited

U.S. PATENT DOCUMENTS 3,724,200 4/1973 Donner ..... 368/149
4,760,564 7/1988 Odagiri ..... 368/66

FOREIGN PATENT DOCUMENTS 1834479 6/1961 Fed. Rep. of Germany .
13259 .11/1961 Switzerland .
1308 1/1971 Switzerland .
890349 2/1962 United Kingdom .

*Primary Examiner*—Bernard Roskoski
*Attorney, Agent, or Firm*—Griffin, Branigan & Butler

[57] ABSTRACT

A barrel spring winding device comprises a solar cell (3) arranged to receive ambient light, a capacitor (4) connected to the terminals of the cell, a stepping motor (6) and a control circuit (5). The input of the circuit is connected to the terminals of the capacitor and its output to the terminals of the motor. The rotor of the motor is operatively connected to wind a barrel spring, for example of a watch. The cell (3) charges the capacitor (4) and when the voltage thereof, measured by a differential amplifier (23), reaches a reference voltage ($V_r$), the capacitor is connected to the terminals of the motor by a switching transistor (27). Discharge of the capacitor supplies to the motor a drive pulse whose duration is determined by a one-shot flip-flop (25). After the pulse, the capacitor is once again charged by the cell. To prevent the motor from receiving a drive pulse before it has stopped, i.e. in the event of intense lighting of the cell, another one-shot flip-flop (29) inhibits control of the switching transistor (27) during a period of time corresponding to the time needed for the rotor to make one complete step.

11 Claims, 3 Drawing Sheets

DEVICE COMPRISING A SOLAR CELL FOR WINDING A BARREL SPRING

BACKGROUND OF INVENTION

The present invention concerns a device for winding a barrel spring, for example of a timepiece, using the energy of ambient light falling on a solar cell.

Such devices are well known. In one construction they comprise a solar cell receiving ambient light, and a continuously rotating electric motor connected to the cell and coupled to the spring possibly via a gear train. For the motor to be able to turn and wind the spring, the intensity of the ambient light must exceed a given threshold which depends on the resisting torque of the barrel spring. Below this threshold, the light energy falling on the cell is lost.

This drawback is eliminated in a second construction described in Swiss patent CH 428 576 or its equivalent GB 904 400. Here, the device further comprises a capacitor connected to the terminals of the cell and switching relay-means enabling connection of the motor to the terminals of the capacitor when the voltage thereof exceeds a reference voltage corresponding to the voltage necessary for starting rotation of the motor. Since the cell acts essentially like a current generator with the magnitude of the current depending on the light energy received, it is able, even with poor lighting, to charge progressively the capacitor when it is not connected to the motor. Once the reference voltage is reached, the motor is connected by the switching relay-means to the capacitor which thus supplies it for a given time interval with sufficient energy to rewind the spring. After this period of time, when the voltage of the capacitor has become too low to sustain rotation of the motor, the motor is disconnected. Another cycle of charging of the capacitor by the cell and discharge to the motor may then begin.

The ratio between the charging and discharging times of the capacitor depends of course on the intensity of the ambient light illuminating the cell. For a low light intensity, the ratio may be large and in this case the motor operates intermittently. For high light intensities, the ratio may be zero so the motor rotates continuously.

The second type of winding device is an improvement over devices where the motor is directly connected to the cell, but nevertheless still has some drawbacks. On the one hand, the period of time during which the motor is connected to the capacitor is determined in an imprecise manner by mechanical characteristics of the relay forming the switching means. The ill-defined value of this time period means that it cannot correspond to the optimum time for which the device provides the most efficient conversion of light energy into mechanical energy. On the other hand, because with strong illumination the voltage at the terminals of the capacitor (and hence of the motor) remains constant, this device can only be associated with commutator motors. Such motors do not lend themselves to the high degree of miniaturisation necessitated for certain applications, such as the winding of the barrel spring of a watch for example.

The object of the present invention is to propose a winding device which does not suffer from these drawbacks.

To achieve this, the barrel spring winding device according to the invention comprises:

a capacitor;

a solar cell arranged to receive ambient light and to charge the capacitor;

a control circuit connected to terminals of the capacitor; and a motor connected to the circuit and having a rotor operatively connected to wind the spring, and is particularly characterized in that the motor is a stepping motor having two terminals, and that the control circuit comprises:

means for supplying a drive signal having two states, a first state produced in response to a parameter representing the state of charging of the capacitor, and a second state produced after a given period of time from the beginning of the first state; and means for connecting the motor to the terminals of the capacitor in response to the first state of the drive signal and for disconnecting the motor from the capacitor in response to the second state of the drive signal.

One advantage of the device according to the invention is that the motor receives pulses of precisely defined duration and amplitude which ensures optimal operating conditions for the device.

Another advantage of the device is that it comprises a stepping motor, i.e. the type of motor whose miniaturization involves the fewest problems. These stepping motors are the only ones that can be used where the available space is extremely restricted, as is in particular the case with watches.

Other characteristics and advantages of the winding device according to the present invention will be apparent from the following description, made with reference to the accompanying drawings and given by way of non-limiting explanation, of an embodiment of such a device.

BRIEF DESCRIPTION OF THE DRAWINGS

In the drawings, where the same references designate like elements.

DETAILED DESCRIPTION

Figure 1:
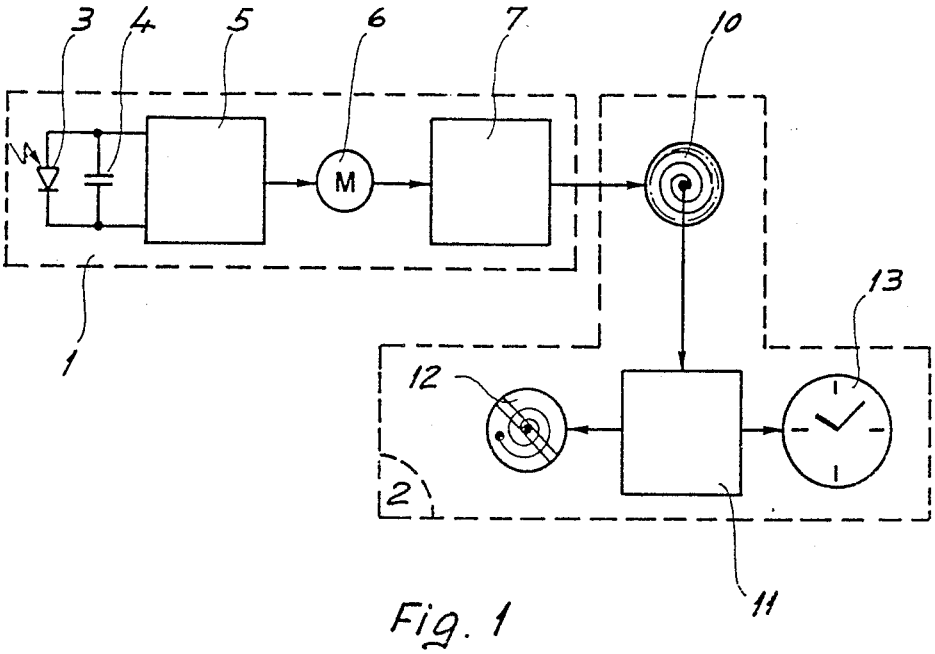
FIG. 1 shows a block diagram of a winding device according to the invention and a conventional mechanical watch-movement with the motor of the device arranged to wind the barrel spring of the movement.

An embodiment of the winding device according to the invention will be described by way of example in relation to a particularly advantageous application illustrated in FIG. 1. The winding device, designated by reference 1 in this Figure, is associated with a conventional mechanical watch-movement 2, which together form an automatic analog watch in which the winding energy, instead of being produced by movement of the wearer's arm, is produced by ambient light. The watch will thus be wound up, whether or not it is being worn, as long as it receives light energy. Of course, this device has many other potential applications, for example that of carrying out the mechanical functions in a photographic camera.

To convert the energy of natural or artificial ambient light into electrical energy, the winding device 1 employs a solar cell 3 arranged on the watch so as to receive this ambient light. The cell 3 may include several cell elements, for example of silicon, connected in series and/or in parallel to supply a current typically of 150 microamperes at 3 volts for average lighting, i.e. about 1000 lux. This current may vary within a wide range, between 10 microamperes and 15 mlliamperes depending on whether the the watch is in semi-darkness or bright sunlight, which corresponds to an illumination from 50 lux to 100 000 lux.

A capacitor 4 of about 1.5 microfarad is connected to the terminals of the cell 3 to store the energy produced by this cell. The common terminals of the cell 3 and capacitor 4 are then connected to the two input terminals of a control circuit 5 which delivers at its output drive pulses to a non-polarised stepping motor 6 of known type. Lastly, the motor 6 is connected to a gear train 7 which adapts the characteristics of the motor to those of the load it must drive.

The control circuit 5 is energised by the capacitor 4. The voltage of the capacitor 4, even under poor illumination, does not drop below about 2 V. This voltage is thus sufficient to supply the circuit 5 whose minimum operating voltage is typically 1 V. Of course, in darkness, there is no need to energise the circuit 5 because the motor 6 cannot operate. As the current consumption of the circuit 5 is very low, this circuit may advantageously be supplied by a complementary cell of reduced surface area.

Supposing the solar cell 3 receives light while the capacitor 4 is initially discharged, the current supplied by cell 3 charges the capacitor 4 and raises the voltage thereof. After a given time, the voltage at the terminals of capacitor 4 reaches the value corresponding to a reference voltage and the circuit 5 operates as a switch and connects the terminals of the capacitor 4 to the terminals of the motor 6 during a predetermined period of time. The capacitor 4 then supplies a well defined drive pulse to the motor 6 to make it advance by one step. After the pulse, the circuit 5 disconnects motor 6 from capacitor 4.

This drive pulse partially discharges the capacitor 4 so that its voltage drops below the reference value and resets circuit 5 to its initial state. As the motor 6 is disconnected from capacitor 4 after the pulse, the current supplied by cell 3 will once again charge the capacitor 4 and raise its voltage. When the reference voltage is reached, motor 6 will receive from capacitor 4 another drive pulse identical to the previous one.

The duration of a drive pulse for a watch motor is typically 2.4 milliseconds and, under normal lighting conditions, such a motor makes 50 to 100 steps per second.

If the ambient light is very strong, the cell 3 may possibly supply a current approaching or even greater than the current extracted from the capacitor 4 by motor 6 during the drive pulse. The motor 6 could then receive pulses which are too close together for normal operation, or even receive no pulse if the voltage of capacitor 4 remained permanently above the reference voltage. To avoid these difficulties, circuit 5 also comprises means preventing the period of time separating two succesive drive pulses from dropping below a predetermined minimum period of time corresponding to the amount of time needed for the motor to make one complete step.

The watch movement 2 associated with the winding device 1 comprises a barrel spring 10, a gear-train 11 driven by spring 10, a sprung balance 12 caused to oscillate by gear-train 11 to regularize rotation of the different wheels of the watch-movement, and an analog time display 13 driven by gear-train 11. The barrel spring 10 is coupled to the gear-train 7 so as to be wound at each step of the motor 6. The watch-movement 2 and winding device 1 thus constitute an autonomous watch requiring for its operation only ambient light of sufficient intensity, typically about 160 lux.

Figure 2:
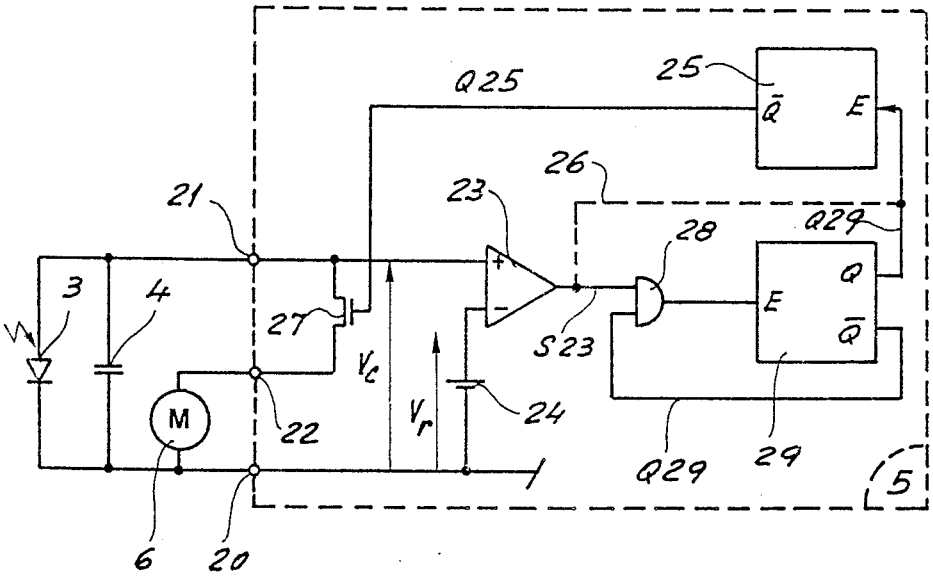
FIGS. 2 to 5 show different possible embodiments of the electronic circuit of the winding device shown in FIG. 1.

An embodiment of the electronic circuit 5 is shown in detail in FIG. 2. This circuit has a common terminal 20, considered as ground terminal, an input terminal 21 and an output terminal 22. The solar cell 3 and capacitor 4 are connected across the terminals 20 and 21 so that the voltage of terminal 21, measured relative to the terminal 20 and designated $V_c$, is positive when the cell is illuminated. The stepping motor 6, of the single-winding type operating in response to unipolar drive pulses, is connected across the terminals 20 and 22.

Inside the circuit 5, the terminal 21 is connected to the non-inverting input of a differential amplifier 23, whereas the inverting input of amplifier 23 is raised to a positive reference voltage $V_r$ equal to the already-mentioned voltage and measured relative to the ground terminal 20. The voltage $V_r$, of about 2V, is supplied by a stable voltage source 24 that can be a battery or, preferably, a circuit of known type performing the same function. The output of amplifier 23 supplies a logic triggering signal S23 which is low when $V_c-V_r$ is negative and high when $V_c-V_r$ is positive, the passage from one state to the other taking place when the two voltages are substantially equal.

Suppose for the time being that the signal S23 is applied directly to the input E of a one-shot flip-flop 25 by means of a conductor 26. The output $\overline{Q}$ of this flip-flop issues a signal Q25 made up of negative pulses of amplitude $V_c$ and fixed duration $t_1$, each pulse being triggered by the signal S23 as it goes from low to high.

The signal $\overline{Q}$25 is finally applied to the gate of a P-type MOS switching transistor 27 whose source is connected to terminal 21 and whose drain is connected to terminal 22. Thus, between the pulses of signal $\overline{Q}$25, the transistor 27 is in the blocked or non-conductive state and during these pulses is in the saturated or conducting state.

When the amplifier 23 is connected to flip-flop 25 by the conductor 26, the circuit of FIG. 2 operates as follows. As long as the watch is in darkness the motor 6 cannot operate because the voltage $V_c$ is zero. When the watch is then exposed to light for instance of average intensity, the cell 3 charges capacitor 4 and the voltage $V_c$ begins to increase. During this charging period of capacitor 4, the flip-flop 25 is in its stable state and the voltage of signal $\overline{Q}$25 is near to voltage $V_c$ which is supposed to be sufficient to block transistor 27.

As soon as the voltage $V_c$ reaches the value of reference voltage $V_r$, the signal S23 goes from low to high. This triggers flip-flop 25 whose output $\overline{Q}$ goes from voltage $V_c$ to practically zero and produces saturation of transistor 27. The terminals 21 and 22 are thus short circuited during the time period $t_1$, enabling the capacitor 4 to supply a defined drive pulse to motor 6 whereby the motor operates at optimum efficiency.

The drive pulse of course discharges the capacitor 4, causing the voltage $V_c$ to drop at the end of the period of time $t_1$ to about 1.6 V, i.e. a value below the voltage $V_r$ which is typically about 2 V. At this moment, the transistor 27 is thus again in the blocked state and the signal S23 in the low state.

As the circuit has reassumed its initial state, a new cycle can begin, namely the charging of capacitor 4 by cell 3, then the delivery of a drive pulse at the instant when voltage $V_c$ becomes equal to voltage $V_r$.

The charging time of capacitor 4 depends on the intensity of the ambient light, a low intensity corresponding to a long charging time and drive pulses spaced well apart. For strong intensities, the reverse applies. Now, in stepping motors, the optimum duration $t_1$ of the drive pulses is usually two to three times less than the time needed for one complete step of the rotor. This means that, for the motor to be able to operate in normal conditions, the period of time separating two successive drive pulses should not drop below a certain threshold value.

In the case of the circuit of FIG. 2, when the amplifier 23 is connected to the flip-flop 25 by conductor 26, this threshold, under strong lighting, may well be reached. If the lighting is very strong, it is even possible for the current supplied by the cell 3 to be greater than the current flowing through motor 6 during the drive pulse and prevent discharge of the capacitor 4. In these conditions, the voltage $V_c$ is permanently maintained at a value greater than voltage $V_r$. The circuit is then blocked and cannot supply any more drive pulses after the first one.

To avoid this difficulty, instead of conductor 26, the circuit of FIG. 2 comprises an AND gate 28 having two inputs, and a one-shot flip-flop 29. This flip-flop supplies at its output Q a control signal Q29 made up of positive pulses of amplitude $V_c$ and duration $t_2$, each pulse being triggered by its input E going from the low state to the high state. The output of amplifier 23 is connected to one input of the AND gate 28 whose output is connected to the input E of flip-flop 29. The other input of AND gate 28 receives, from the flip-flop 29, a signal $\overline{Q}29$ complementary to signal Q29. The time period $t_2$ is made equal to or slightly greater than the time taken by the rotor of motor 6 to make one complete step, and is typically 5 to 6 milliseconds.

When the flip-flop 29 is in its stable state, the signal Q29 is in the low state, corresponding to zero voltage, and signal $\overline{Q}29$ is high, corresponding to voltage $V_c$. In these conditions, the AND gate 28 is open to signal S23. Transition of this signal from low to high triggers flip-flop 29. The signal Q29 thus goes high and in turn triggers flip-flop 25 which results in a drive pulse of duration $t_1$ being sent to the terminals of motor 6. At the end of the time period $t_1$, the signal $\overline{Q}29$ is still low because the flip-flop 29 goes back to its stable state only at the end of time period $t_2$. After the drive pulse, the AND gate 28 thus continues to remain blocked to the signal S23 during time $t_2 - t_1$ because these two time periods begin at the same instant, thus allowing the rotor to complete the step it has begun. Another drive pulse can be produced only at the end of time period $t_2$, when flip-flop 29 has gone back to its stable state. Therefore, whatever may be the intensity of the ambient light, the time period separating two successive drive pulses cannot be less than the time the rotor takes to make one complete step.

The circuit 5 can, as mentioned above, be supplied directly by the voltage $V_c$ of capacitor 4. However, as this voltage varies typically between 2 V and 2.4 V, it may be advisable to connect an extra solar cell (not shown) so that its voltage adds onto the voltage $V_c$, and to supply the circuit 5 with the resulting voltage. Independent cells supplying a stable voltage could also be used for this supply, or a known type of voltage multiplier circuit connected to the terminals of the capacitor and supplying for example a voltage which is twice voltage $V_c$. As the consumption of circuit 5 is very low relative to that of motor 6, these expedients would not lead to a substantial increase in the surface area of the cell or of the integrated circuit incorporating the control circuit 5.

Figure 3:
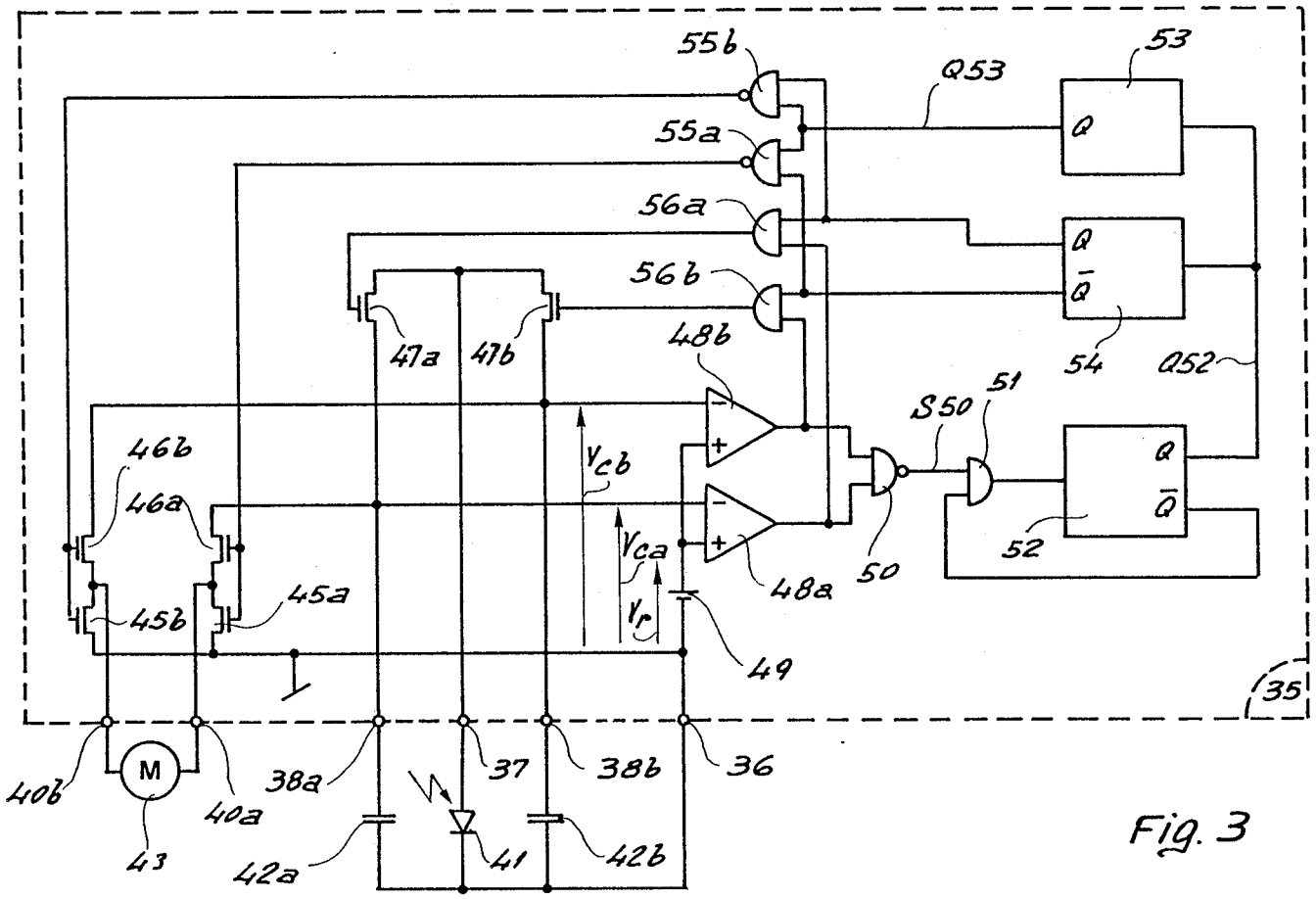

Another embodiment of the circuit involved in the winding device according to the invention is shown in FIG. 3. It differs from the previous embodiment mainly in that the drive pulses are supplied by two capacitors operating alternately. While one of these capacitors supplies a drive pulse, the other is being charged by the cell and vice versa. This arrangement improves the efficiency of the conversion of light energy into mechanical energy.

In FIG. 3, reference 35 designates the control circuit which includes a ground terminal 36, three input terminals 37, 38*a* and 38*b* and two output terminals 40*a* and 40*b*. To the terminal 37 is connected one terminal of a solar cell 41 analogous to the cell 3 of FIG. 2. To the terminal 38*a* is connected one terminal of a capacitor 42*a* and to the terminal 38*b* one terminal of a capacitor 42*b*. These capacitors have a capacitance of about 1.5 microfarad and have the same function as the capacitor 4 of FIG. 2. The other terminals of cell 41 and capacitors 42*a*, 42*b* are connected to terminal 36, the cell 41 being so oriented that when it receives light the voltage of terminal 37 is positive relative to the terminal 36. Between the terminals 40*a* and 40*b* is connected a stepping motor 43 of the well known polarised type.

Drive pulses, alternately positive and negative, are supplied to the motor 43 by a drive circuit comprising two N-type MOS transistors 45*a* and 45*b* and two P-type transistors 46*a* and 46*b*. The sources of transistors 45*a* and 45*b* are connected to the terminal 36 and the sources of transistors 46*a* and 46*b* are connected respectively to the terminals 38*a* and 38*b*. The drains of transistors 45*a* and 46*a* are connected to the terminal 40*a*, and the drains of transistors 45*b* and 46*b* are connected to terminal 40*b*. Finally, the gates of transistors 45*a* and 45*b* are connected together and form one of the two inputs of the drive circuit, whereas the gates of transistors 45*b* and 46*b* form the other input of this circuit.

Terminal 37 is connected to the sources of two P-type MOS transistors 47*a* and 47*b*, the drain of transistor 47*a* being connected to terminal 38*a* and the drain of transistor 47*b* to terminal 38*b*. The terminal 38*a* is also connected to the inverting input of a high-gain differential amplifier 48*a* and terminal 38*b* is connected to the inverting input of a differential amplifier 48*b* identical to 48*a*. The non-inverting inputs of these amplifiers are raised to a positive reference voltage $V_r$, measured relative to terminal 36, by means of a voltage source 49 similar to source 24 of FIG. 2.

The outputs of amplifiers 48*a* and 48*b* are connected to the inputs of a two-input NAND gate 50 . The output of NAND gate 50 is in turn connected to one input of a two-input AND gate 51 whose output is connected to the input of a one-shot flip-flop 52 having an output Q and a complementary output $\overline{Q}$. The latter output is connected to the other input of AND gate 51. The AND gate 51 and flip-flop 52 are identical to and perform the same functions as the AND gate 28 and flip-flop 29, respectively, of FIG. 2.

The output Q of one-shot flip-flop 52 is connected to the input of a one-shot flip-flop 53 having an output Q and to the input of a bistable flip-flop 54 having an output Q and a complementary output $\overline{Q}$. Flip-flop 53 is identical to and performs the same function as the one-shot flip-flop 25 of FIG. 2, except that the output Q of flip-flop 53 is complementary to the output $\overline{Q}$ of flip-flop 25. The output Q of flip-flop 53, supplying a signal Q53, is connected to one input of a two-input NAND gate 55*a* and to one input of a NAND gate 55*b* similar to 55*a*. The output Q of flip-flop 54 is connected to the other input of gate 55*b* and to one input of a two-input AND gate 56*a*, whereas the output $\overline{Q}$ of this flip-flop is connected to the other input of NAND gate 55*a* and to one input of a two-input AND gate 56*b*. The other inputs of AND gates 56*a* and 56*b* are connected respectively to the outputs of amplifiers 48*a* and 48*b*. The output of NAND gate 55*a* is connected to the gates of transistors 45*a* and 46*a*, whereas the output of NAND gate 55*b* is connected to the gates of transistors 45*b* and 46*b*. Finally, the outputs of AND gates 56*a* and 56*b* are connected respectively to the gates of transistors 47*a* and 47*b*.

The supply means for circuit 35 is not shown. As with the circuit 5 of FIG. 2, circuit 35 may for example be supplied directly from the voltage supplied by the cell 41.

Operation of the circuit 35 of FIG. 3 is as follows. Suppose that the cell 41 is abruptly illuminated by light of average intensity while the capacitors 42*a* and 42*b* are discharged. In these conditions, the circuit 35 is energised by cell 41, and flip-flop 54 assumes a given state, for example with its output W high and output $\overline{Q}$ low. The flip-flops 52 and 53 are in the initial state, which corresponds to their outputs Q being low. The voltages of capacitors 42*a* and 42*b*, respectively designated as $V_{ca}$ and $V_{cb}$, are lower than the reference voltage $V_r$.

In these conditions, the outputs of amplifiers 48*a* and 48*b* and of gates 55*a*, 55*b* and 56*b* are high whereas the outputs of gates 50 and 56*b* are low. As a result, transistors 45*a*, 45*b* and 47*a* are saturated or conductive, while transistors 46*a*, 46*b* and 47*b* are blocked or non-conductive. The motor 43 is thus short-circuited by transistors 45*a* and 45*b* and the cell 41 charges capacitor 42*a* via transistor 47*a*.

When the voltage $V_{ca}$ reaches the reference value $V_r$, the output of amplifier 48*a* goes from high to low and the output of gate 50, supplying a triggering signal S50, goes from low to high. The change of the output of gate 50 actuates the one-shot flip-flop 52, in the same manner as was described for trigger 29, and produces at its output Q a control signal Q52 formed of a positive pulse of duration $t_2$. The latter pulse trips the flip-flop 54 and triggers the one-shot flip-flop 53 which then produces at its output Q a positive pulse of duration $t_1$ whose positive edge coincides with the positive edge of the pulse of duration $t_2$.

Just after the change of the output signal of amplifier 48*a*, the outputs of gates 55*b* and 56*b* are thus high while the outputs of gates 55*a* and 56*a* are low. In these conditions, the transistors 45*b*, 46*a* and 47*b* are saturated while the transistors 45*a*, 46*b* and 47*a* are blocked. It follows that the motor 43 is connected by transistors 45*a* and 46*a* to the capacitor 42*a* which supplies to motor 43 a first drive pulse having a duration equal to the duration $t_1$ of the pulse delivered by flip-flop 53. If the rotor of motor 43 is in the right position it will move one step; otherwise it will only turn in response to the next drive pulse of opposite polarity.

When the first drive pulse is triggered, the cell 41 is connected via transistor 47*b* to the terminals of capacitor 42*b* to charge it in turn. After the drive pulse supplied by capacitor 42*a*, the voltage of this capacitor is less than the voltage $V_r$, while capacitor 42*b* continues to be charged by cell 41.

Charging of the capacitor 42*b* lasts for the time required for the voltage $V_{cb}$ to reach value $V_r$. At the instant when $V_{cb}$ becomes equal to $V_r$, the output signal of amplifier 48*b* goes from high to low, triggers flip-flops 52 and 53 and produces a change of state in flip-flop 54. This causes the outputs of gates 55*a* and 56*a* to go high and the outputs of gates 55*b* and 56*b* to go low. In these conditions, the transistors 45*a*, 46*b* and 47*a* are saturated and transistors 45*b*, 46*a* and 47*b* are blocked. The motor 43 is thus connected via transistors 45*a* and 46*b* to the terminals of capacitor 42*b* so as to receive a second drive pulse of opposite polarity to the first, while capacitor 42*a* is connected via transistor 47*a* to the terminals of cell 41 to be recharged.

A new cycle will begin terminating, after a greater or lesser length of time depending on the intensity of the ambient light, with the production of a third drive pulse identical to the first.

If the initial state of flip-flop 54 were the opposite of what was supposed, this would simply cause reversal of the polarity of the drive pulses.

Operation of the circuit 35 of FIG. 3 has been described for the case of ambient lighting of average intensity. For strong light intensities, the one-shot flip-flop 52 would, like flip-flop 29 of the circuit 5 of FIG. 2, prevent the time period between two drive pulses from dropping below the time period $t_2$ corresponding to the duration of the pulses supplied by this flip-flop.

With knowledge of the circuits of FIGS. 2 and 3, persons skilled in the art would easily be able to adapt the first circuit to drive a polarised motor, and the second circuit to drive a non-polarised motor.

In the described embodiments of the control circuit 5, the drive pulse is triggered when the voltage of the capacitor reaches a reference voltage, and the duration of this pulse is determined by the relaxation time of a one-shot flip-flop.

Figure 4:
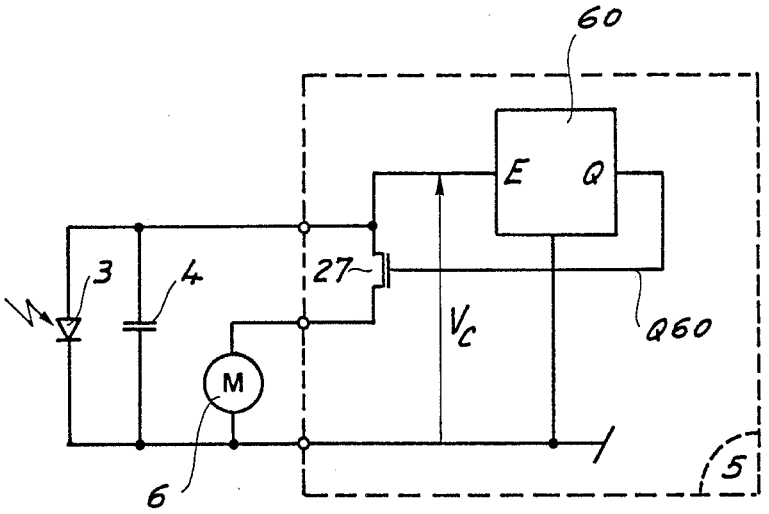

Of course, the duration of the drive pulse could be set in a different manner. For example, in the embodiment of the control circuit 5 shown in FIG. 4, the voltage $V_c$ of capacitor 4 is applied to the input E of a Schmitt trigger 60, the output Q of this trigger, supplying a signal Q60, being connected to the gate of switching transistor 27. The signal Q60 is made up of negative pulses of amplitude $V_c$, each pulse beginning at the instant when the voltage $V_c$ applied to the input E rises to a first voltage threshold and then ending when the voltage drops to a second threshold lower than the first.

Between the pulses of signal Q60, transistor 27 is blocked and the voltage $V_c$ increases, the capacitor 4 being then charged by cell 3. Once the voltage $V_c$ reaches the first threshold, a pulse issues at the output Q of trigger 60 and saturates transistor 27. The capacitor 4 then supplies a drive pulse to motor 6 with a large flow of current which lowers voltage $V_c$. When voltage $V_c$ reaches the second threshold, the pulse at the output of trigger 60 ends and transistor 27 passes to the blocked state and ends the drive pulse. In this instance, the duration of the drive pulse is therefore defined by the discharge time of capacitor 4 to the motor 6 between the first and second voltage thresholds.

In the already-considered configurations of the control circuit 5, the drive pulse is triggered by the voltage of the capacitor, this voltage being a parameter representative of the state of charge of the capacitor. Instead of voltage, other parameters depending on the state of charge of the capacitor could also be used.

Figure 5:
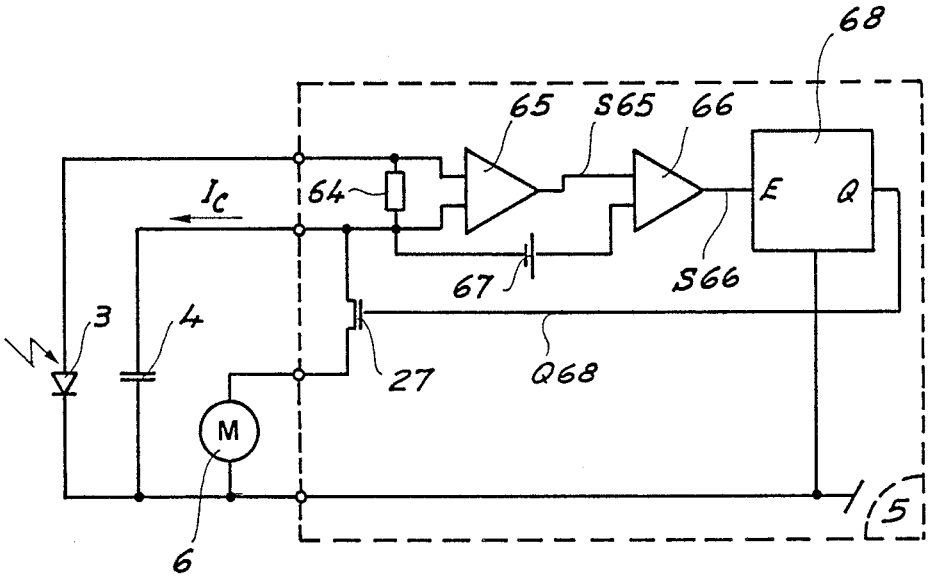

Hence, in the control circuit 5 shown in FIG. 5, the drive pulse is triggered by the current $I_c$ supplied by the cell 3 to charge capacitor 4. For a given lighting, the open-circuit voltage of cell 3 does not exceed a given limit, so that the current $I_c$ drops as the charge of the capacitor increases. In this case, the drive pulse is triggered when the current $I_c$ drops to a predetermined reference current. The duration of the pulse is then given by the relaxation time of a one-shot flip-flop.

To this end, the circuit of FIG. 5 comprises, in series with the cell 3 and capacitor 4, a resistor 64 through which current $I_c$ passes. The voltage at the terminals of resistor 64, which is a measure of current $I_c$, is applied to the input of an amplifier 65 supplying a signal S65 which is also representative of current $I_c$. The signal S65 is a voltage which is applied to one input of a differential amplifier 66. The other input of amplifier 66 receives a reference voltage supplied by a voltage source 67. In response to these voltages, the output of amplifier 66 issues a logic signal S66. A reference value $I_{cr}$ for current $I_c$ is defined when the voltages at the inputs of amplifier 66 are equal, signal S66 being low when $I_c$ is greater than $I_{cr}$ and high when it is not. Signal S66 is applied to the input E of a one-shot flip-flop 68 that issues on its output Q a signal Q68 made up of negative pulses of fixed duration, equal to the previously-defined time period $t_1$. Each pulse is triggered by signal S66 going from low to high. Signal Q68 is applied to the gate of transistor 27, this transistor connecting the motor 6 to the terminals of capacitor 4 during the pulses of signal Q68 so that capacitor 4 supplies the drive pulse.

Of course, the described winding device may be further modified and incorporate other changes evident to persons skilled in the art, without departing from the scope of the present invention.

We claim:

1. A barrel-spring winding device comprising:

a capacitor having terminals;

a solar cell arranged to receive ambient light and to charge said capacitor;

a control circuit connected to terminals of said capacitor; and a motor connected to said circuit and having a rotor operatively connected to wind the spring, wherein said motor is a stepping motor having two terminals, and the control circuit comprises:

means for supplying a drive signal having a first state or a second state and including first means for setting said drive signal to said first state in response to a charge parameter representing the state of charge of the capacitor, and second means for resetting said drive signal to said second state a fixed interval of time after the beginning of said first state; and means for connecting said motor to the terminals of said capacitor in response to the first state of said drive signal and for disconnecting said motor from said capacitor in response to the second state of said drive signal.

2. A device according to claim 1, wherein said charge parameter is the voltage at the terminals of said capacitor.

3. A device according to claim 1, wherein said charge parameter is the current supplied by said solar cell to the capacitor.

4. A device according to claim 1, wherein said means for supplying a drive signal comprises means for comparing said charge parameter to a reference value and for producing a triggering signal when said charge parameter is substantially equal to said reference value, and means for producing a bi-level logic signal in response to said triggering signal, one level of said logic signal corresponding to said first state of said drive signal and the other to said second state of said drive signal.

5. A barrel-spring winding device comprising:

a capacitor;

a solar cell arranged to receive ambient light and to charge said capacitor;

a control circuit connected to terminals of the capacitor; and a motor connected to said circuit and having a rotor operatively connected to wind the spring, wherein said motor is a stepping motor having two terminals and the control circuit comprises:

means for supplying a drive signal having two states, a first state produced in response to a parameter representing the state of charge of the capacitor, and a second state produced after a given period of time from the beginning of the first state; and means for connecting said motor to the terminals of the capacitor in response to the first state of the drive signal and for disconnecting the motor from the capacitor in response to the second state of the drive signal said means for supplying said drive signal comprising:

means for comparing said charge parameter to a reference value and producing a triggering signal when said charge parameter is substantially equal to the reference value;

means for producing a pulse in response to said triggering signal, said pulse having a duration equal to a second period of time at least equal to the time needed by said rotor to make on complete step to prevent the motor from being connected to the capacitor before it is stopped; and means for producing a bi-level logic signal in response to said pulse, the level of said logic signal at the beginning of the pulse corresponding to the first state of the triggering signal and its other level corresponding to said second state of the triggering signal.

6. A device according to claim 4 or 5, wherein said means for producing said bi-level logic signal comprise a first one-shot flip-flop having a relaxation time equal to said first period of time and arranged to receive on its input said triggering signal.

7. A device according to claim 4 or 5, wherein said means for connecting said motor to the terminals of said capacitor comprises a switching transistor arranged between one terminal of the capacitor and one terminal of the motor, the other terminals of the motor and capacitor being connected together, said transistor having a control electrode receiving said logic signal.

8. A device according to claim 5, wherein said means for producing a pulse comprise:

an AND gate, one input of said gate being connected to the output of said means for comparing the charge parameter with a reference value so as to receive said triggering signal; and a second one-shot flip-flop having a relaxation time equal to said second period of time, the input of said second flip-flop being connected to the output of the AND gate, its inverting output to another input of the AND gate, and the direct output of said second flip-flop supplying said pulse.

9. A device according to claim 1, wherein said means for producing said drive signal comprise a threshold circuit for supplying a bi-level logic signal in response to said charge parameter, one level of this logic signal corresponding to said first state being produced when said charge parameter reaches a first reference value, and the other level corresponding to said second state being produced when said charge parameter reaches a second reference value.

10. A device according to claim 9, wherein said threshold circuit comprises a Schmitt trigger.

11. A barrel-spring winding device, comprising:

two capacitors;

a solar cell arranged to receive ambient light and to alternately charge said capacitors;

a stepping motor having a rotor operatively connected to wind the spring;

means for comparing a charge parameter of each capacitor with a reference value and producing a triggering signal when the charge parameter of one of the capacitors is substantially equal to said reference value;

means for producing a pulse in response to said triggering signal, said pulse having a duration equal to a period of time which is at least equal to the time needed for the rotor to make a complete step to prevent the motor from being connected to one of the capacitors before being stopped;

means for producing a logic signal in response to said pulse, said logic signal passing to a first level at the beginning of the pulse and to a second level at a subsequent period of time;

connection means for selectively connecting the motor to one of the capacitors and connecting the cell to the other capacitor; and switching means for controlling said connection means, in response to said pulse, said logic signal and the values of the charge parameters of the capacitors, so that the motor is connected during said subsequent period of time to whichever of the capacitors has a charge parameter substantially equal to said reference value, and the cell is connected to the other capacitor until the charge parameter of said other capacitor has reached the reference value.

* * * * *